US011732731B2

(12) United States Patent
Xue et al.

(10) Patent No.: US 11,732,731 B2
(45) Date of Patent: Aug. 22, 2023

(54) DIFFUSER AND DESWIRL SYSTEM WITH INTEGRAL TANGENTIAL ONBOARD INJECTOR FOR ENGINE

(71) Applicant: HONEYWELL INTERNATIONAL INC., Charlotte, NC (US)

(72) Inventors: Song Xue, Morristown, NJ (US); Raymond Mccage, Phoenix, AZ (US); Jeffrey Krise, Phoenix, AZ (US); Shakeel Nasir, Phoenix, AZ (US); Joseph Becar, Phoenix, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

(21) Appl. No.: 17/450,306

(22) Filed: Oct. 8, 2021

(65) Prior Publication Data

US 2023/0111022 A1 Apr. 13, 2023

(51) Int. Cl.

| | |
|---|---|
| ***F04D 29/44*** | (2006.01) |
| ***F04D 29/66*** | (2006.01) |
| ***F04D 17/10*** | (2006.01) |

(52) U.S. Cl.

CPC ..... *F04D 29/441* (2013.01); *F04D 17/10* (2013.01); *F04D 29/667* (2013.01)

(58) Field of Classification Search

CPC ..... F04D 29/441

See application file for complete search history.

(56) References Cited

U.S. PATENT DOCUMENTS

| | | | | |
|---|---|---|---|---|
| 3,420,435 | A * | 1/1969 | Kenny | F04D 29/441 415/206 |
| 3,856,430 | A * | 12/1974 | Langham | F04D 29/682 415/207 |
| 4,344,737 | A * | 8/1982 | Liu | F04D 29/441 415/199.1 |
| 6,123,506 | A | 9/2000 | Brand et al. | |
| 6,276,896 | B1 * | 8/2001 | Burge | F04D 29/284 415/115 |
| 6,280,139 | B1 * | 8/2001 | Romani | F04D 29/441 415/207 |
| 6,540,481 | B2 * | 4/2003 | Moussa | F01D 5/145 415/208.2 |

(Continued)

FOREIGN PATENT DOCUMENTS

| | | | |
|---|---|---|---|
| EP | 2206902 | A2 | 7/2010 |
| WO | 2016057112 | A1 | 4/2016 |

*Primary Examiner* — Justin D Seabe

(74) *Attorney, Agent, or Firm* — Lorenz & Kopf, LLP

(57) ABSTRACT

A diffuser and deswirl system associated with an engine includes a throat ring defining a plurality of passages spaced apart about a perimeter of the throat ring, a plurality of pockets and a support flange. Each passage of the plurality of passages is to receive a working fluid and each pocket of the plurality of pockets is defined about a portion of a respective passage of the plurality of passages. The diffuser and deswirl system includes a plurality of conduits, with each conduit including a first conduit end and a second conduit end opposite the first conduit end. The first conduit end of each conduit is received within and coupled to the pocket of a respective one of the plurality of passages to receive the working fluid, and each conduit includes a mating feature defined between the first conduit end and the second conduit end coupled to the support flange.

19 Claims, 11 Drawing Sheets

(56) References Cited

U.S. PATENT DOCUMENTS

| | | | | |
|---|---|---|---|---|
| 8,038,392 | B2 | 10/2011 | Honda et al. | |
| 8,425,188 | B2 * | 4/2013 | Dovbush | F04D 29/441 415/208.2 |
| 9,803,652 | B2 | 10/2017 | Duong et al. | |
| 2020/0049076 | A1 | 2/2020 | Balike et al. | |
| 2020/0325911 | A1 | 10/2020 | Mazur | |
| 2020/0393129 | A1 | 12/2020 | Duong | |
| 2021/0033109 | A1 | 2/2021 | Kojovic et al. | |

* cited by examiner

DIFFUSER AND DESWIRL SYSTEM WITH INTEGRAL TANGENTIAL ONBOARD INJECTOR FOR ENGINE

TECHNICAL FIELD

The present disclosure generally relates to engines, and more particularly relates to a diffuser and deswirl system that includes an integrally formed tangential on-board injector for an engine, such as a gas turbine engine.

BACKGROUND

Engines may be employed to provide power to various devices. For example, a gas turbine engine may be employed as an auxiliary power unit to provide power to a mobile platform, such as an aircraft, tank, etc. In certain examples, gas turbine engines may include a centrifugal compressor, which may raise a velocity and pressure of a fluid, such as air, prior to the fluid reaching a combustion chamber. In these examples, a diffuser may be employed to reduce a velocity of the fluid prior to the fluid reaching the combustion chamber. In addition, a deswirl may be positioned downstream of the diffuser to reduce a tangential velocity associated with the air prior to the air reaching the combustion chamber. In certain instances, the diffuser may be mechanically coupled to a tangential on-board injector that provides cooling air to a turbine associated with the gas turbine engine.

Typically, the diffuser and the deswirl have a complex geometry and a large number of parts, which results in increased cost and manufacturing complexity. In addition, due to the complex geometry, the diffuser may have limited line-of-sight during assembly, which further increases manufacturing complexity. Further, the coupling of the diffuser to the tangential on-board injector requires numerous mechanical fasteners, which increases a weight and an installation complexity for the diffuser and tangential on-board injector.

Accordingly, it is desirable to provide a diffuser and deswirl system for an engine, such as a gas turbine engine, which reduces manufacturing complexity and cost. It is also desirable to provide a diffuser and deswirl system that includes a tangential on-board injector, which is integrally formed with a portion of the diffuser and deswirl system. Furthermore, other desirable features and characteristics of the present invention will become apparent from the subsequent detailed description and the appended claims, taken in conjunction with the accompanying drawings and the foregoing technical field and background.

SUMMARY

According to various embodiments, provided is a diffuser and deswirl system associated with an engine. The diffuser and deswirl system includes a throat ring defining a plurality of passages spaced apart about a perimeter of the throat ring, a plurality of pockets and a support flange. Each passage of the plurality of passages is configured to receive a working fluid and each pocket of the plurality of pockets is defined about a portion of a respective passage of the plurality of passages. The diffuser and deswirl system includes a plurality of conduits, with each conduit including a first conduit end and a second conduit end opposite the first conduit end. The first conduit end of each conduit is received within and coupled to the pocket of a respective one of the plurality of passages to receive the working fluid, and each conduit includes a mating feature defined between the first conduit end and the second conduit end coupled to the support flange.

The support flange further comprises a plurality of support ribs that extend radially outward from the support flange for coupling to the mating feature of each conduit. The plurality of support ribs are arranged in pairs of support ribs about the perimeter of the throat ring, with each support rib of the pairs of support ribs interconnected with a bridge, and the mating feature of each conduit is coupled to the bridge. The mating feature is a protrusion that extends above a surface of each conduit, and a base of the protrusion is coupled to the bridge. The diffuser and deswirl system includes at least one coupling flange integrally formed with at least one of the plurality of support ribs. The first conduit end of each conduit extends along a first axis that is coaxial with the respective one of the plurality of passages, and the second conduit end extends along a second axis, which is different than the first axis. Each passage of the plurality of passages is defined at an acute angle relative to the throat ring. The throat ring includes a first side and a second side opposite the first side, and the support flange extends radially from the first side. The first conduit end of each conduit includes a conduit coupling portion about a terminal end that is received within the pocket of the respective one of the plurality of passages. The diffuser and deswirl system includes a tangential on-board injector integrally formed with the throat ring. Each passage includes a passage inlet opposite a passage outlet, and each pocket of the plurality of pockets is defined about a respective passage outlet. Each pocket of the plurality of pockets is defined about the portion of the respective passage to define a mating surface to stop an advancement of the first conduit end of the respective conduit within the respective passage. Each pocket of the plurality of pockets includes a pocket flange that partially surrounds the first conduit end. The plurality of pockets are defined about the perimeter of the throat ring such that a volume is defined between adjacent pockets of the plurality of pockets. Each pocket of the plurality of pockets is partially recessed into the throat ring such that the first conduit end is received within the throat ring.

Also provided is a diffuser and deswirl system associated with an engine. The diffuser and deswirl system includes a throat ring defining a plurality of passages spaced apart about a perimeter of the throat ring, a plurality of pockets and a support flange. Each passage of the plurality of passages is configured to receive a working fluid, and each pocket of the plurality of pockets is defined about a portion of a respective passage of the plurality of passages and recessed at least partially into the throat ring. Each pocket of the plurality of pockets includes a pocket flange. The diffuser and deswirl system includes a plurality of conduits, with each conduit including a first conduit end and a second conduit end opposite the first conduit end. The first conduit end of each conduit is received within and coupled to the pocket of a respective one of the plurality of passages to receive the working fluid. The pocket flange at least partially surrounds the first conduit end, and each conduit including a protrusion defined between the first conduit end and the second conduit end that extends outwardly and is coupled to the support flange.

The support flange further comprises a plurality of support ribs that extend radially outward from the support flange for coupling to the protrusion of each conduit. The plurality of support ribs are arranged in pairs of support ribs about the perimeter of the throat ring, with each support rib of the pairs of support ribs interconnected with a bridge, and the protrusion of each conduit is coupled to the bridge. The throat ring includes a first side and a second side opposite the first side, the support flange extends radially from the first side and a tangential on-board injector is integrally formed with the second side of the throat ring. The first conduit end of each conduit includes a conduit coupling portion about a terminal end that is received within the pocket of the respective one of the plurality of passages and a collar that defines a notch that receives the respective pocket flange. Each pocket of the plurality of pockets is defined about the portion of the respective passage to define a mating surface to stop an advancement of the first conduit end of the respective conduit within the respective passage.

DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
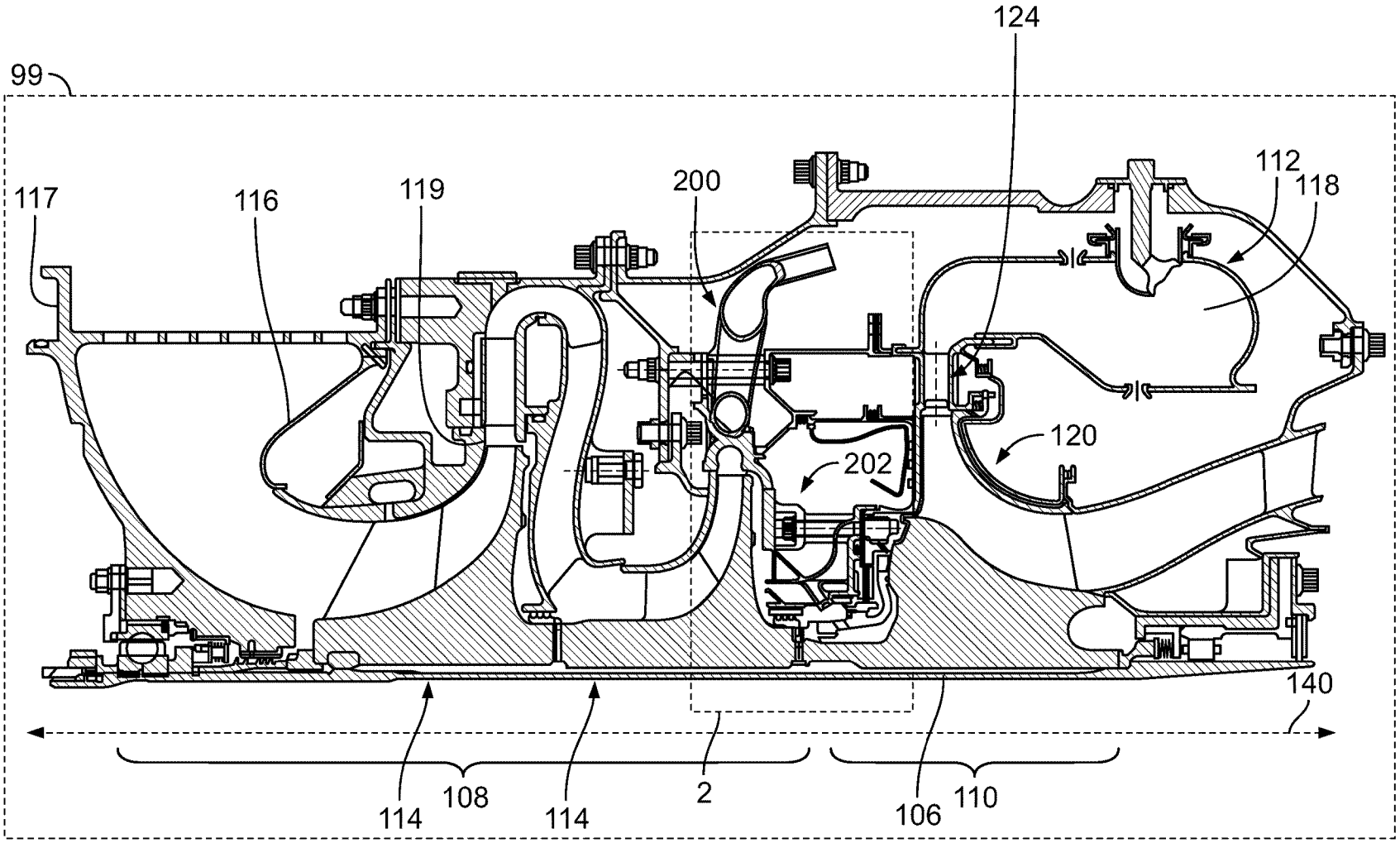
FIG. 1 is a schematic cross-sectional illustration of a gas turbine engine, which includes an exemplary diffuser and deswirl system and integrally formed tangential on-board injector in accordance with the various teachings of the present disclosure.

The following detailed description is merely exemplary in nature and is not intended to limit the application and uses. Furthermore, there is no intention to be bound by any expressed or implied theory presented in the preceding technical field, background, brief summary or the following detailed description. In addition, those skilled in the art will appreciate that embodiments of the present disclosure may be practiced in conjunction with any type of engine that would benefit from a diffuser and deswirl system with an integral tangential on-board injector, and the use of the diffuser and deswirl system and tangential on-board injector with a gas turbine engine described herein is merely one exemplary embodiment according to the present disclosure. In addition, while the diffuser and deswirl system and tangential on-board injector are described herein as being used with a gas turbine engine onboard a mobile platform, such as a bus, motorcycle, train, motor vehicle, marine vessel, aircraft, rotorcraft and the like, the various teachings of the present disclosure can be used with a gas turbine engine on a stationary platform. Further, it should be noted that many alternative or additional functional relationships or physical connections may be present in an embodiment of the present disclosure. In addition, while the figures shown herein depict an example with certain arrangements of elements, additional intervening elements, devices, features, or components may be present in an actual embodiment. It should also be understood that the drawings are merely illustrative and may not be drawn to scale.

As used herein, the term "axial" refers to a direction that is generally parallel to or coincident with an axis of rotation, axis of symmetry, or centerline of a component or components. For example, in a cylinder or disc with a centerline and generally circular ends or opposing faces, the "axial" direction may refer to the direction that generally extends in parallel to the centerline between the opposite ends or faces. In certain instances, the term "axial" may be utilized with respect to components that are not cylindrical (or otherwise radially symmetric). For example, the "axial" direction for a rectangular housing containing a rotating shaft may be viewed as a direction that is generally parallel to or coincident with the rotational axis of the shaft. Furthermore, the term "radially" as used herein may refer to a direction or a relationship of components with respect to a line extending outward from a shared centerline, axis, or similar reference, for example in a plane of a cylinder or disc that is perpendicular to the centerline or axis. In certain instances, components may be viewed as "radially" aligned even though one or both of the components may not be cylindrical (or otherwise radially symmetric). Furthermore, the terms "axial" and "radial" (and any derivatives) may encompass directional relationships that are other than precisely aligned with (e.g., oblique to) the true axial and radial dimensions, provided the relationship is predominantly in the respective nominal axial or radial direction.

With reference to FIG. 1, a simplified cross-sectional view of an exemplary gas turbine engine 100 is shown with the remaining portion of the gas turbine engine 100 being axisymmetric about a longitudinal axis 140, which also comprises an axis of rotation for the gas turbine engine 100. As will be discussed herein, the gas turbine engine 100 includes a diffuser and deswirl system 200 for increasing static pressure rise, reducing velocity, and reducing a tangential velocity of a working fluid, in one example, air, received from a compressor section 108. As will be discussed, the diffuser and deswirl system 200 provides ease of assembly and reduced manufacturing costs. In one example, a portion of the diffuser and deswirl system 200 is integrally formed, monolithic or one-piece with a tangential on-board injector 202. By integrally forming a portion of the diffuser and deswirl system 200 with the tangential on-board injector 202, mechanical fasteners may be reduced or eliminated for securing the tangential on-board injector 202 to the portion of the diffuser and deswirl system 200, which reduces installation complexity and a weight of the gas turbine engine 100.

It should be noted that while the diffuser and deswirl system 200 is illustrated and described herein as being used with the gas turbine engine 100, which can be included with an auxiliary power unit, the diffuser and deswirl system 200 can be employed with various types of engines, including, but not limited to, turbofan, turboprop, turboshaft, and turbojet engines, whether deployed onboard an aircraft, watercraft, or ground vehicle (e.g., a tank), included within industrial power generators, or utilized within another platform or application. In this example, the gas turbine engine 100 is employed within an aircraft 99.

In the example shown in FIG. 1, the gas turbine engine 100 is illustrated as a single spool engine. It should be noted that the use of a single spool engine is merely exemplary, as any number of spools can be employed. A tie-shaft 106 extends along an axis of rotation or longitudinal axis 140 of the gas turbine engine 100. In this example, the gas turbine engine 100 includes a compressor section 108, a combustion section 112, and a turbine section 110. In certain examples, the compressor section 108 includes one or more compressors 114, which are mounted to an upstream or forward end of the tie-shaft 106. The compressors 114 are in communication with a compressor section duct 116 to receive airflow from an intake section 117 of the gas turbine engine 100. The compressors 114 pressurize the air in the compressor section duct 116. The diffuser and deswirl system 200 is in communication with an impeller exit 119 of the compressor section 108 to receive the working fluid or compressed air, and provides static pressure rise while reducing velocity and the tangential velocity of the working fluid. The diffuser and deswirl system 200 is in communication with the combustion section 112 to deliver the air to a combustion chamber 118 of the combustion section 112.

The combustion section 112 includes the combustion chamber 118. The compressed air from the diffuser and deswirl system 200 is mixed with fuel and ignited to produce combustive gases in the combustion chamber 118. The combustive gases are directed from the combustion chamber 118 to the turbine section 110. The turbine section 110 includes at least one radial turbine 120, which is mounted to an opposing, aft end of the tie-shaft 106 as the turbine for the gas turbine engine 100. The turbine section 110 also includes a turbine nozzle 124, which is in fluid communication with the combustion section 112 to receive combustion gases from the combustion chamber 118. The turbine nozzle 124 directs the combustion gases through the radial turbine 120. In addition, in this example, the turbine section 110 includes the tangential on-board injector 202. The tangential on-board injector 202 provides cooling fluid to the at least one radial turbine 120 of the turbine section 110.

The combustion gases drive rotation of the radial turbine 120, which drives further rotation of the tie-shaft 106 and the compressors 114. The rotation of the rotating group provides power output, which may be utilized in a variety of different manners, depending upon whether the gas turbine engine 100 assumes the form of a turbofan, turboprop, turboshaft, turbojet engine, or an auxiliary power unit, to list but a few examples.

Figure 2:
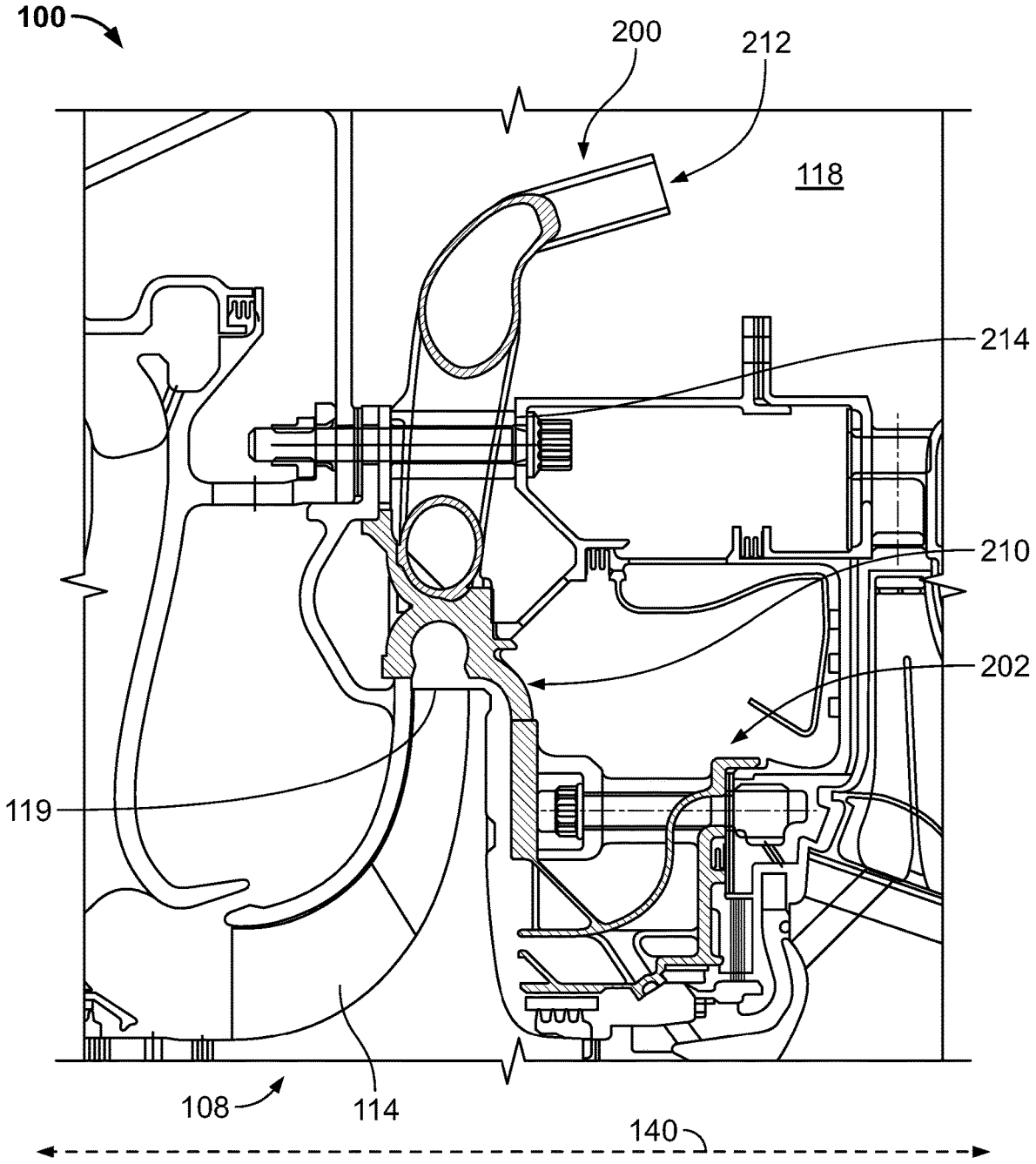
FIG. 2 is a detail cross-sectional view of the diffuser and deswirl system and integrally formed tangential on-board injector taken from 2 on FIG. 1.

With reference to FIG. 2, a detail cross-sectional view of the gas turbine engine 100 is shown, which illustrates the diffuser and deswirl system 200 and the tangential on-board injector 202. In this example, the diffuser and deswirl system 200 includes a throat ring 210 and at least one or a plurality of pipes or conduits 212. The diffuser and deswirl system 200 may also include one or more spacers 214. As shown in FIG. 2, in this example, the tangential on-board injector 202 is integrally formed, monolithic or one-piece with the throat ring 210. By integrally forming the tangential on-board injector 202 with the throat ring 210, mechanical fasteners are eliminated, which reduces weight and the installation complexity associated with the tangential on-board injector 202. The throat ring 210 and the tangential on-board injector 202 are composed of a metal or metal alloy, including, but not limited to INCONEL™ 718 produced by Special Metals Corporation of New Hartford, N.Y., USA, and are manufactured through additive manufacturing, including, but not limited to direct metal laser sintering (DMLS). It should be noted that while the throat ring 210 of the diffuser and deswirl system 200 is shown and described herein as being integrally formed with the tangential on-board injector 202, in certain embodiments, the throat ring 210 may be manufactured separately from the tangential on-board injector 202 and the tangential on-board injector 202 may be coupled to the throat ring 210 via welding. Thus, in certain embodiments, the diffuser and deswirl system 200 is separate and discrete from the tangential on-board injector 202, and in other embodiments, the tangential on-board injector 202 is integrally or monolithically formed with the throat ring 210.

The throat ring 210 is in fluid communication with the impeller exit 119 of the compressor section 108, downstream from one of the compressors 114. In this example, the throat ring 210 is positioned radially outboard of a last one of the compressors 114 in the compressor section 108. Stated another way, the throat ring 210 is coupled about the last one of the compressors 114 so as to surround a trailing edge of the last one of the compressors 114 to receive the compressed air. Generally, the throat ring 210 surrounds or circumscribes the last one of the compressors 114 in the compressor section 108 such that the throat ring 210 is downstream of the last one of the compressors 114 and upstream from the combustion chamber 118. The throat ring 210 receives the compressed air from the compressors 114, and cooperates with the conduits 212 to increase static pressure rise while reducing velocity and the tangential velocity of the compressed air prior to delivering the compressed air to the combustion chamber 118. The throat ring 210 is centered about the longitudinal axis 140 of the gas turbine engine 100 and extends along a centerline C (FIG. 3).

Figure 3:
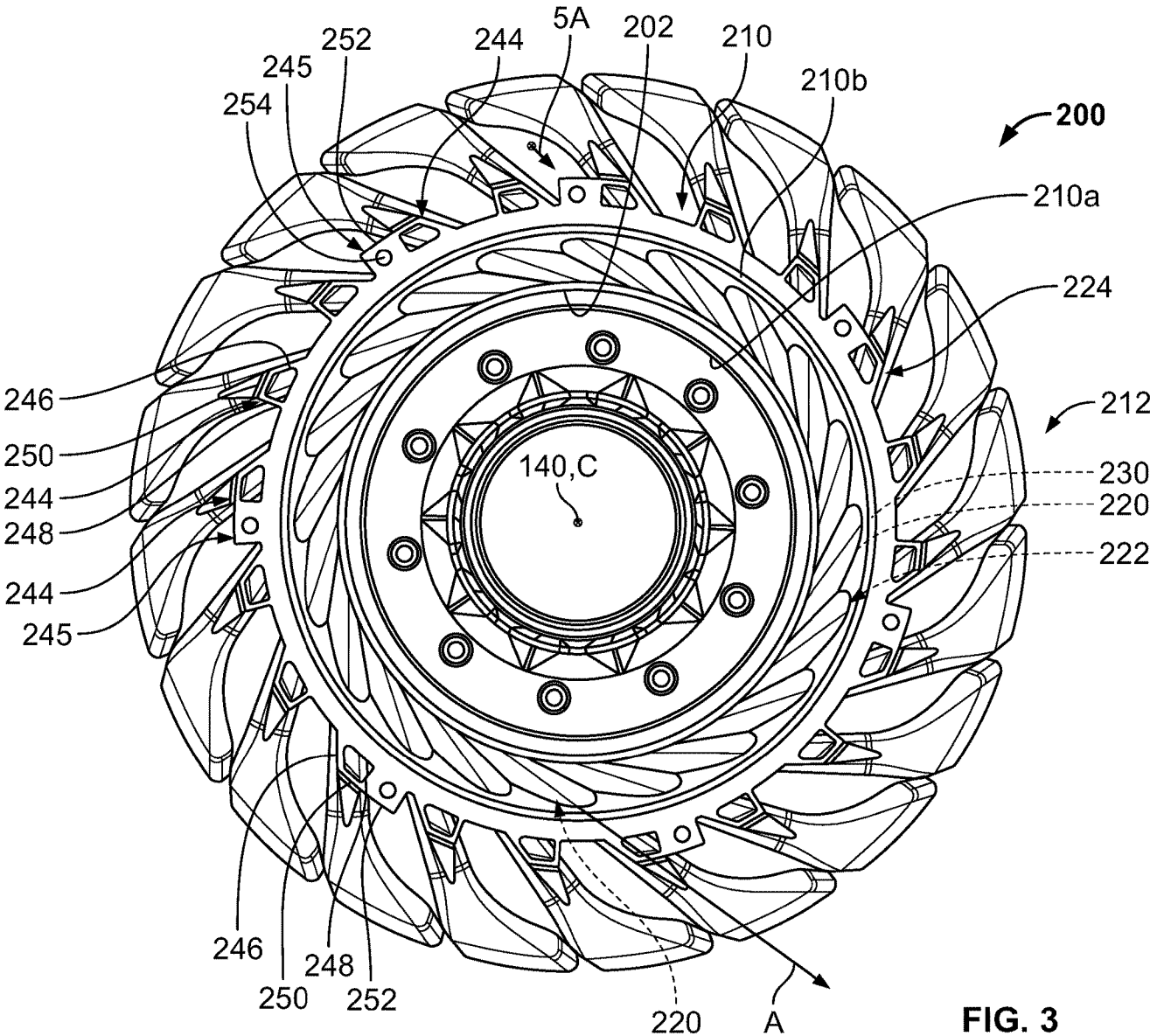
FIG. 3 is a forward side view of the diffuser and deswirl system and the tangential on-board injector.
Figure 4:
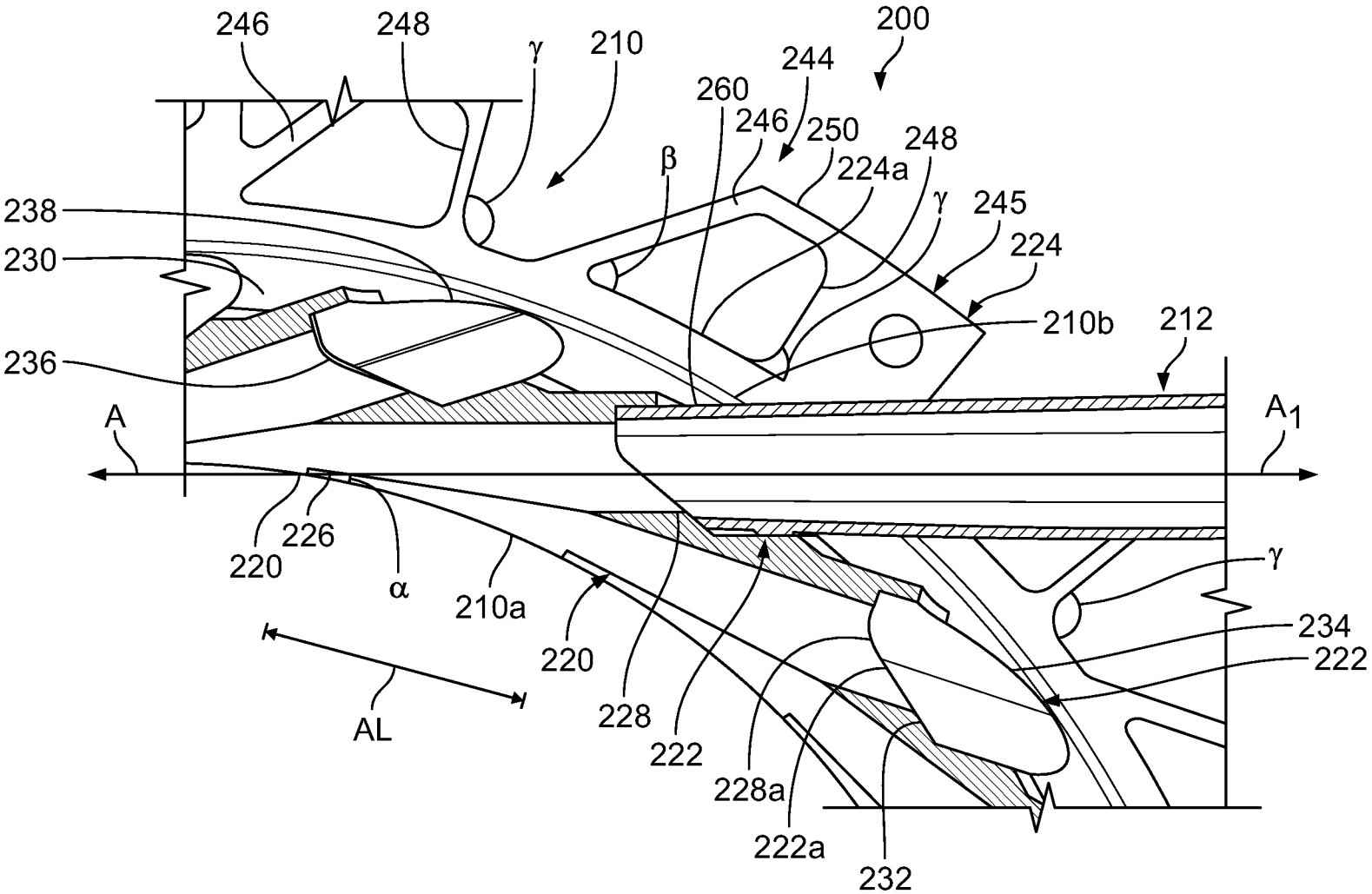
FIG. 4 is a cross-sectional view of the diffuser and deswirl system taken at line 4-4 of FIG. 11.

With reference to FIG. 3, a forward end view of the diffuser and deswirl system 200 is shown with the integrally formed tangential on-board injector 202. The throat ring 210 includes at least one or a plurality of passages 220, at least one or a plurality of pockets 222 (FIG. 4) and a support flange 224. Generally, a respective one of the passages 220 and the pockets 222 corresponds to a respective one of the conduits 212. Stated another way, for each one of the conduits 212, the throat ring 210 includes a respective passage 220 and pocket 222. In this example, the throat ring 210 includes twenty passages 220 and pockets 222 to correspond with twenty conduits 212, however, the diffuser and deswirl system 200 may include any number of conduits 212 and the throat ring 210 may include any number of corresponding passages 220 and pockets 222. Each of the passages 220 extend radially from an inner perimeter or diameter 210*a* of the throat ring 210 to an outer perimeter or diameter 210*b* of the throat ring 210. The inner diameter 210*a* of the throat ring 210 is open to define a throat, and the passages 220 direct the compressed air from the throat into the individual conduit 212 downstream of the throat. Each of the passages 220 extend between the inner diameter 210*a* and the outer diameter 210*b* of the throat ring 210 in a different radial direction similar to the spokes of a wheel. In this example, each of the passages 220 are defined in the throat ring 210 to extend along a respective axis A, which is transverse to the longitudinal axis 140 and is a centerline of the respective passage 220. The centerline C of the throat ring 210 is coaxial with the longitudinal axis 140 of the gas turbine engine 100. With reference to FIG. 4, an angle α is defined between the respective axis A at the location where the respective axis A is tangent to the inner diameter 210*a* of the throat ring 210 and the inner diameter 210*a* of the throat ring 210. Each of the passages 220 are defined at the angle α and in one example, the angle α is an acute angle, and is less than 90 degrees. Thus, each of the passages 220 are defined at an acute angle relative to the throat ring 210. As each of the passages 220 and the pockets 222 are the same, a single one of the passages 220 and the pockets 222 of the throat ring 210 will be discussed in detail herein.

Referring to FIG. 4, a cross-section through a portion of the throat ring 210 and one of the conduits 212 is shown, with the remainder of the conduits 212 removed for clarity. The passage 220 has a passage inlet 226 at the inner diameter 210*a* and a passage outlet 228 proximate the outer diameter 210*b*. As the passage 220 is defined through the throat ring 210 at the angle α, the passage inlet 226 is arcuate and extends for an arc length AL of the inner diameter 210*a*. The passage outlet 228 is oval in shape, and terminates at the pocket 222.

The pocket 222 surrounds the passage outlet 228 of the passage 220 and is shaped to correspond to a first conduit end 260 of the conduit 212. The pocket 222 provides a mating feature for coupling the conduit 212 to the throat ring 210. In one example, the pocket 222 extends from above a surface 230 of the outer diameter 210*b* to the passage outlet 228, and has a substantially oval shape. The pocket 222 has a first pocket end 232 and an opposite second pocket end 234. At the first pocket end 232, the pocket 222 is recessed into the outer diameter 210*b* such that a first conduit end 260 of the conduit 212 is partially received within the throat ring 210. The pocket 222 has a perimeter 222*a* at the first pocket end 232 that is different and larger than a perimeter 228*a* of the passage outlet 228. The difference in the size of the perimeter 222*a* of the pocket 222 forms a ledge or mating surface 236 about the perimeter 228*a* of the passage outlet 228. The mating surface 236 provides a stop for the assembly of the conduit 212 within the passage 220. In this regard, the mating surface 236 inhibits further advancement of the first conduit end 260 of the conduit 212 within the passage 220. The perimeter 222*a* of the pocket 222 is substantially the same from the first pocket end 232 to the second pocket end 234.

Figure 5:
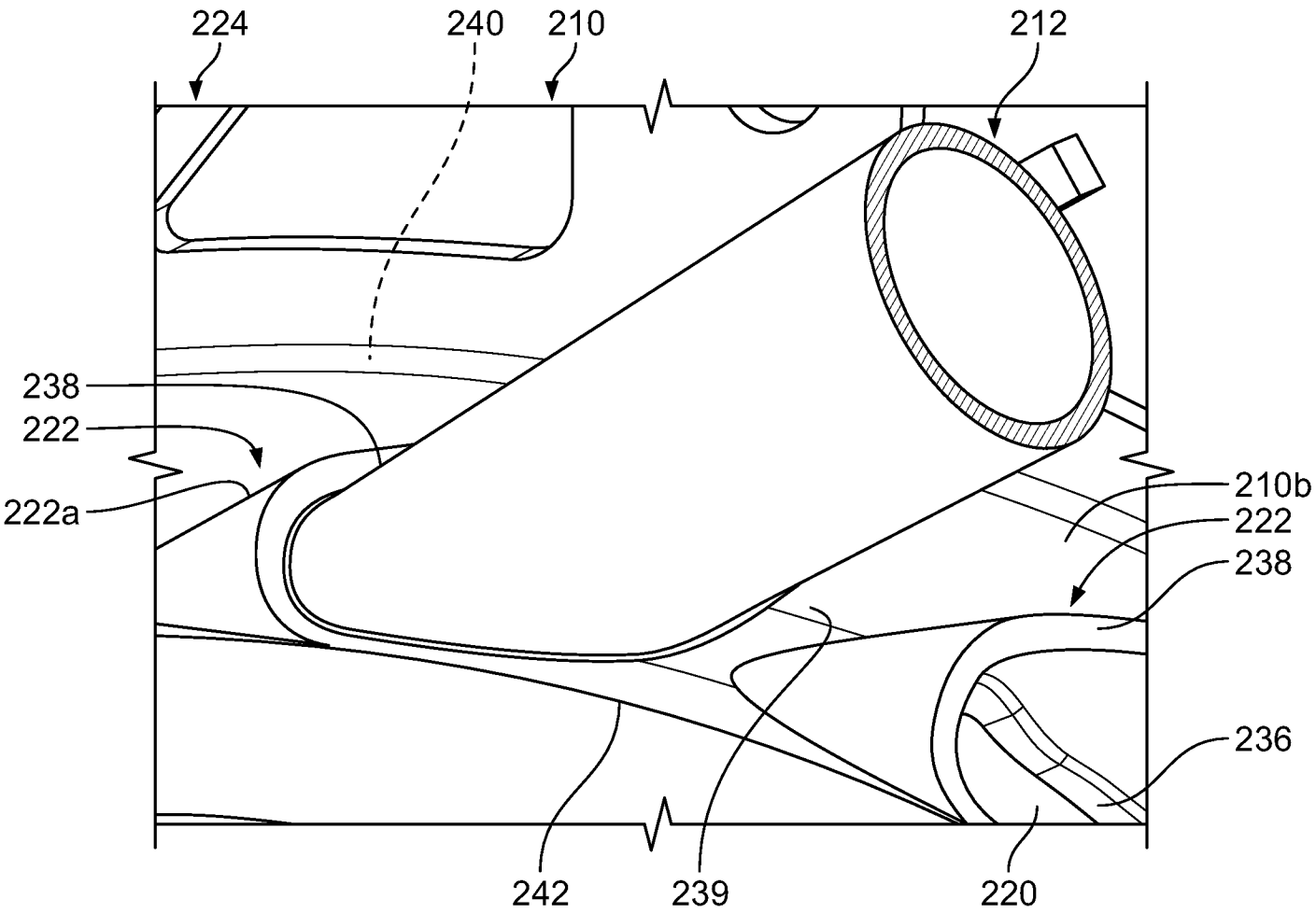
FIG. 5 is a detail view of a conduit of the diffuser and deswirl system coupled to a throat ring of the diffuser and deswirl system.
Figure 10:
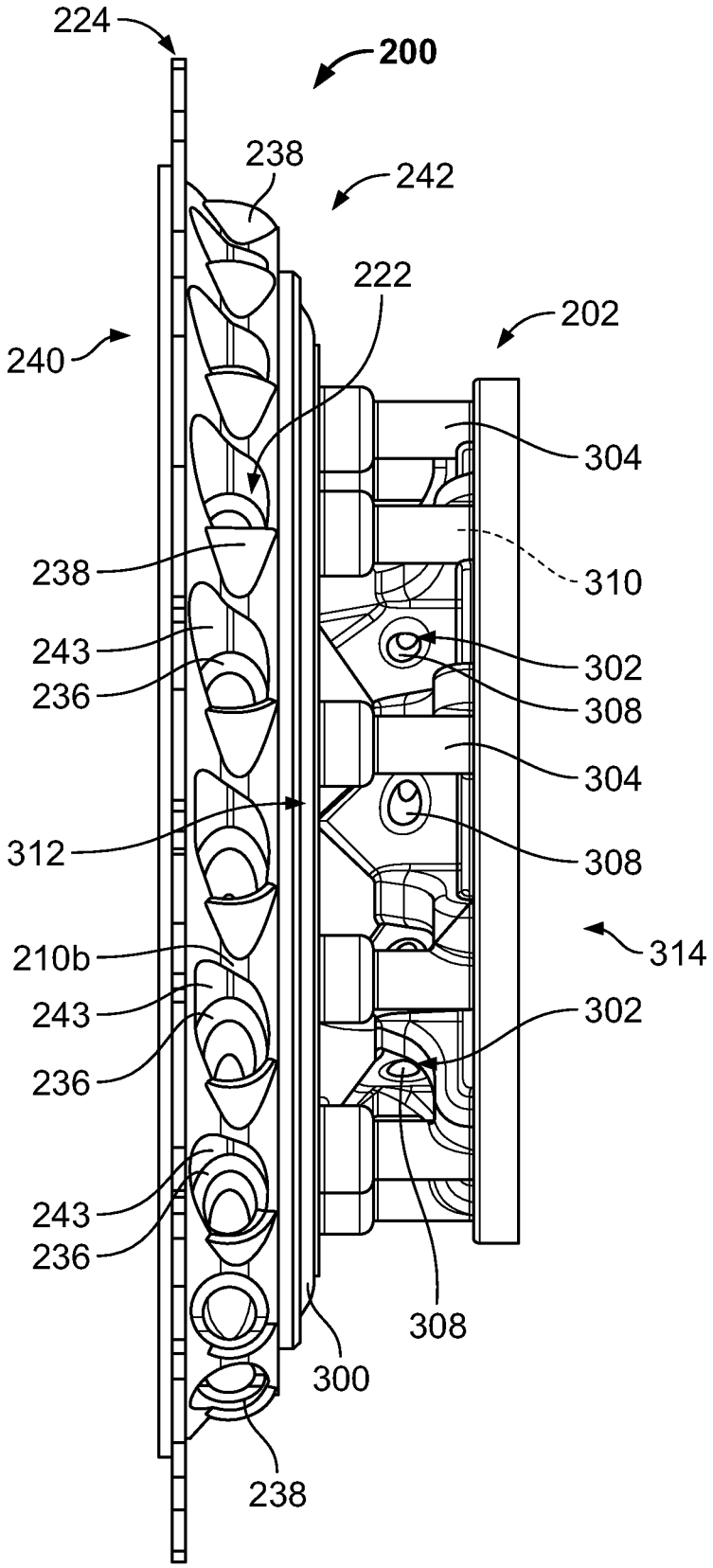
FIG. 10 is an end view of the diffuser and deswirl system and the integrally formed tangential on-board injector.

The second pocket end 234 includes a pocket flange 238. With reference to FIG. 5, the pocket flange 238 surrounds a portion of the perimeter 222*a* of the pocket 222 and extends outwardly from the surface 230. Generally, the pocket flange 238 provides support for the conduits 212. The pocket flange 238 at least partially surrounds or circumscribes the first conduit end 260 of the conduit 212 when the conduit 212 is coupled to the throat ring 210 (FIG. 10). The pocket flange 238 contacts the first conduit end 260 of the conduit 212 when the conduit 212 is fluidly coupled to the passage 220 and coupled to the pocket 222. The pocket flange 238 extends a distance above the surface 230 of the outer diameter 210*b* to assist in coupling the conduit 212 to the throat ring 210 (FIG. 10). Each of the pockets 222 is discrete and spaced apart from an adjacent one of the pockets 222 such that a separation volume generally indicated by reference numeral 239 is defined between adjacent pockets 222 about the outer diameter 210*b* of the throat ring 210. The separation volume 239 enables visual inspection of a joint coupling the conduit 212 to the throat ring 210 by providing a clear line of sight, as will be discussed. Briefly, with reference to FIG. 10, each pocket 222 defines the mating surface 236 that is coupled to and in contact with a collar 270 of the first conduit end 260. A braze surface 243 is defined adjacent to the mating surface 236 to provide an area for applying a braze material to couple the conduit 212 to the throat ring 210. In this example, the conduit 212 is coupled to the throat ring 210 via a braze joint, and the braze material is positioned along a conduit coupling portion 272 and extends along the braze surface 243 to enable a visual indication that the braze joint is properly formed.

Generally, with reference to FIG. 5, the throat ring 210 includes a first, forward side 240 and an opposite second, aft side 242. The pockets 222 are defined proximate or at the aft side 242, while the support flange 224 extends radially from the forward side 240 above the surface 230. With reference back to FIG. 4, the support flange 224 is defined about the entirety of the outer diameter 210*b*. The support flange 224 includes at least one or a plurality of support structures 244 and at least one or a plurality of coupling flanges 245. The support structures 244 are spaced apart about the circumference of the throat ring 210. Each of the support structures 244 includes a first support rib 246, a second support rib 248 and a bridge 250. Thus, generally, the support flange 224 includes a plurality of support ribs (the first support rib 246 and the second support rib 248), which are arranged in pairs about the perimeter of the support flange 224, and thus, the throat ring 210. The first support rib 246 and the second support rib 248 are arranged in pairs about the perimeter of the throat ring 210 and are interconnected by the bridge 250. The first support rib 246 extends at an angle β relative to an outer flange surface 224*a* of the support flange 224. The angle β is an acute angle, which is less than 90 degrees, and in one example, is about 30 degrees to about 60 degrees. The first support rib 246 extends radially outward from the outer flange surface 224*a* to the bridge 250. The second support rib 248 extends radially outward from the outer flange surface 224*a* to the bridge 250. The second support rib 248 extends at an angle γ, which is different than the angle β. In this example, the angle γ is greater than the angle β, and is about 70 degrees to about 90 degrees. The angle β is defined between the second support rib 248 and the outer flange surface 224*a* of the support flange 224. The bridge 250 interconnects the first support rib 246 and the second support rib 248. The bridge 250 is substantially planar, and couples the support flange 224 to the conduit 212, as will be discussed.

With reference back to FIG. 4, the coupling flanges 245 are spaced apart about the circumference of the throat ring 210. In this example, the throat ring 210 includes seven coupling flanges 245, however, the throat ring 210 may include any number of coupling flanges 245. In this example, the coupling flanges 245 are integrally formed with the second support rib 248 and include a substantially square flange body 252. Each flange body 252 defines a bore 254. Each of the bores 254 is coaxially aligned with one of the spacers 214 when the diffuser and deswirl system 200 is assembled to receive a mechanical fastener for coupling the throat ring 210 to a structure of the gas turbine engine 100.

Figure 6:
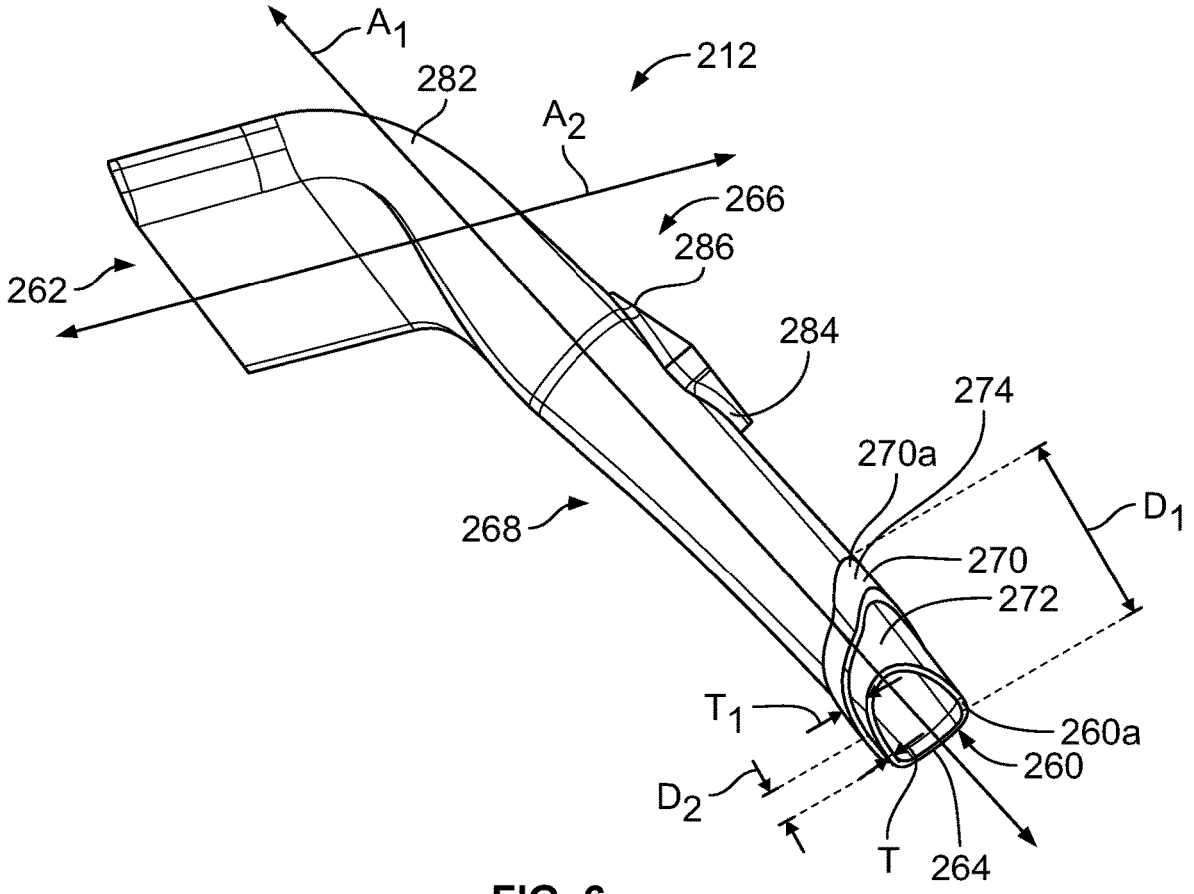
FIG. 6 is a left perspective view of the conduit of the diffuser and deswirl system.

As shown in FIG. 3, the conduits 212 extend radially from the perimeter of the throat ring 210. In this example, the diffuser and deswirl system 200 includes twenty conduits 212, which are each coupled to a respective one of the passages 220. The conduits 212 are each composed of a metal or metal alloy, including, but not limited to INCONEL® alloy 718 commercially available from American Special Metals Inc. of Miami, Fla., USA and may be formed via additive manufacturing, such as DMLS, or may be formed via casting, forging, etc. The conduits 212 are each discretely formed, and are formed separate and discrete from the throat ring 210. As each of the conduits 212 is the same, a single conduit 212 will be discussed in detail herein for ease of description. With reference to FIG. 6, the conduit 212 includes the first conduit end 260, an opposite second conduit end 262 and defines a diffuser passage 264 from the first conduit end 260 to the second conduit end 262. The first conduit end 260 generally extends along a first axis A1, which is different than a second axis A2 along which the second conduit end 262 extends. The second axis A2 is generally oblique to the first axis A1. The first axis A1 is coaxial with the axis A of the passage 220 (FIG. 4) when the conduit 212 is coupled to the throat ring 210. The conduit 212 also includes a first, forward side 266 and an opposite second, aft side 268.

Figure 5A:
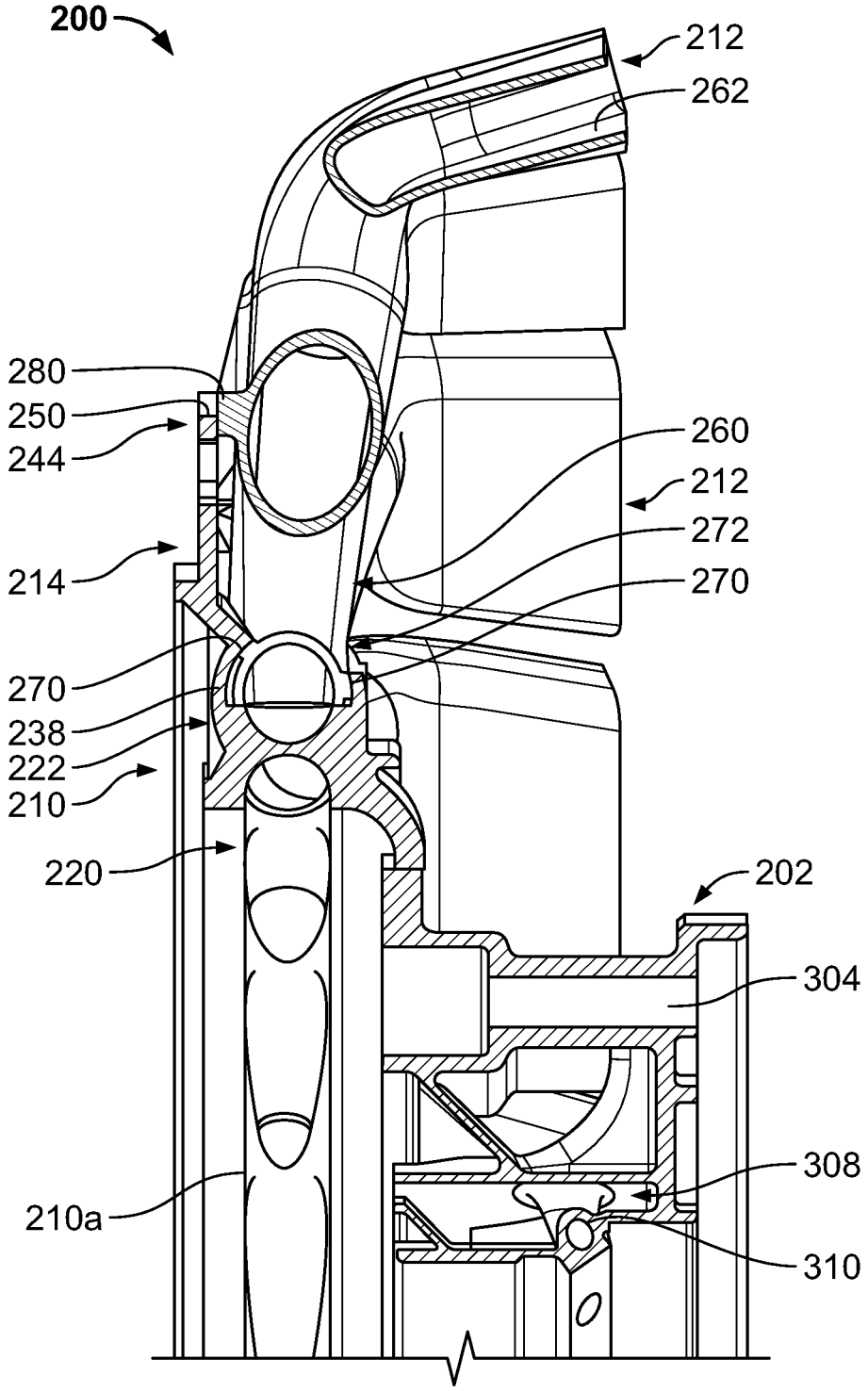
FIG. 5A is a cross-section view of the diffuser and deswirl system and integrally formed tangential on-board injector taken from 5A on FIG. 3.

The first conduit end 260 includes the collar 270 and a conduit coupling portion 272. The collar 270 is defined so as to be spaced apart from a terminal end 260*a* of the first conduit end 260. In one example, the collar 270 extends about a perimeter of the first conduit end 260, and has a distance from the terminal end 260*a* that varies about the perimeter of the first conduit end 260. Generally, the collar 270 is spaced a first distance D1 from the terminal end 260*a* on the forward side 266, and is spaced a second distance D2 from the terminal end 260*a* on the aft side, with the second distance D2 different and less than the first distance D1. The difference in the distances D1, D2 enables the first conduit end 260 to be received within the pocket 222. The first conduit end 260 is at least partially received within the throat ring 210 when the first conduit end 260 is coupled to the pocket 222. In this example, the varying distances of the collar 270 about the perimeter of the first conduit end 260 defines a notch 274 at a peak 270*a* of the collar 270. The notch 274 is shaped to correspond to the pocket flange 238 (FIG. 5). The notch 274 slidably receives the pocket flange 238 (FIG. 5) until the pocket flange 238 contacts the collar 270. The notch 274 and the pocket flange 238 cooperate to provide error proofing for the assembly of the conduit 212 to the throat ring 210, as the notch 274 and the pocket flange 238 ensure that the conduit 212 is coupled to the throat ring 210 in the proper orientation. The notch 274 and the pocket flange 238 also inhibit the rotation of the conduit 212 relative to the throat ring 210. Generally, with reference to FIG. 5A, the conduit 212 is inhibited from rotating relative to the throat ring 210 due to the interference caused by the shape of the conduit coupling portion 272 and the pocket 222, and the alignment of a mating feature or protrusion 280 with the support structure 244.

With reference back to FIG. 6, the conduit coupling portion 272 has a thickness T, which is different and less than a thickness T1 of the collar 270. The reduced thickness T of the conduit coupling portion 272 enables the first conduit end 260 to be received within the pocket 222 (FIGS. 4 and 5) until the terminal end 260*a* contacts the mating surface 236 (FIG. 4) and the pocket flange 238 is received within the notch 274. Thus, generally, the conduit coupling portion 272 is a region of reduced thickness defined about the terminal end 260*a* of the first conduit end 260. The second conduit end 262 is fishtail or fan shaped, and directs the air from the passage 220 into the combustion chamber 118 (FIG. 2). In this example, the second conduit end 262 is vaneless, however, the second conduit end 262 may be formed with one or more vanes that extend along the second axis A2, if desired. Generally, the conduit 212 defines a pipe diffuser passage from the first conduit end 260 to the second conduit end 262 and a fishtail deswirl along the second conduit end 262. Thus, the diffuser passage 264 is a pipe diffuser passage at the first conduit end 260 and transitions at a bend 282 to a fishtail deswirl passage at the second conduit end 262. The diffuser passage 264 is fluidly coupled to the passage 220 to receive the working fluid or air from the compressor section 108.

Figure 7:
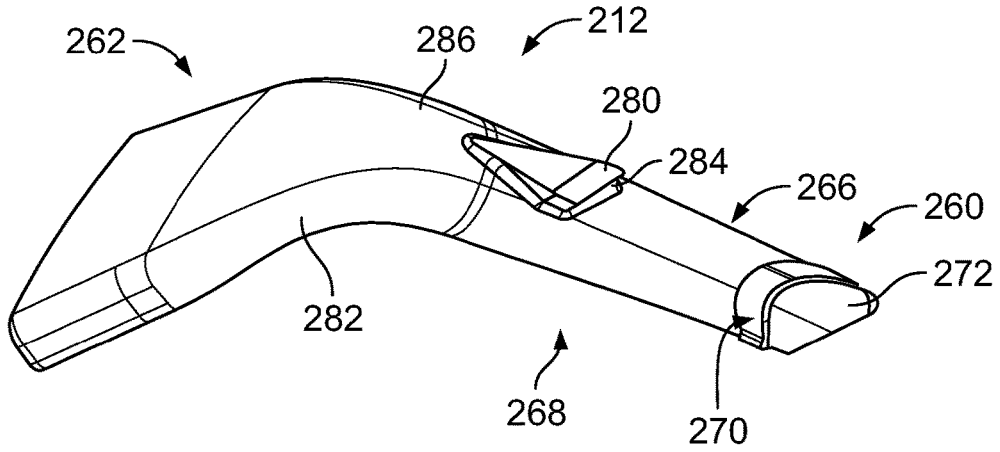
FIG. 7 is a forward perspective view of the conduit of the diffuser and deswirl system.
Figure 8:
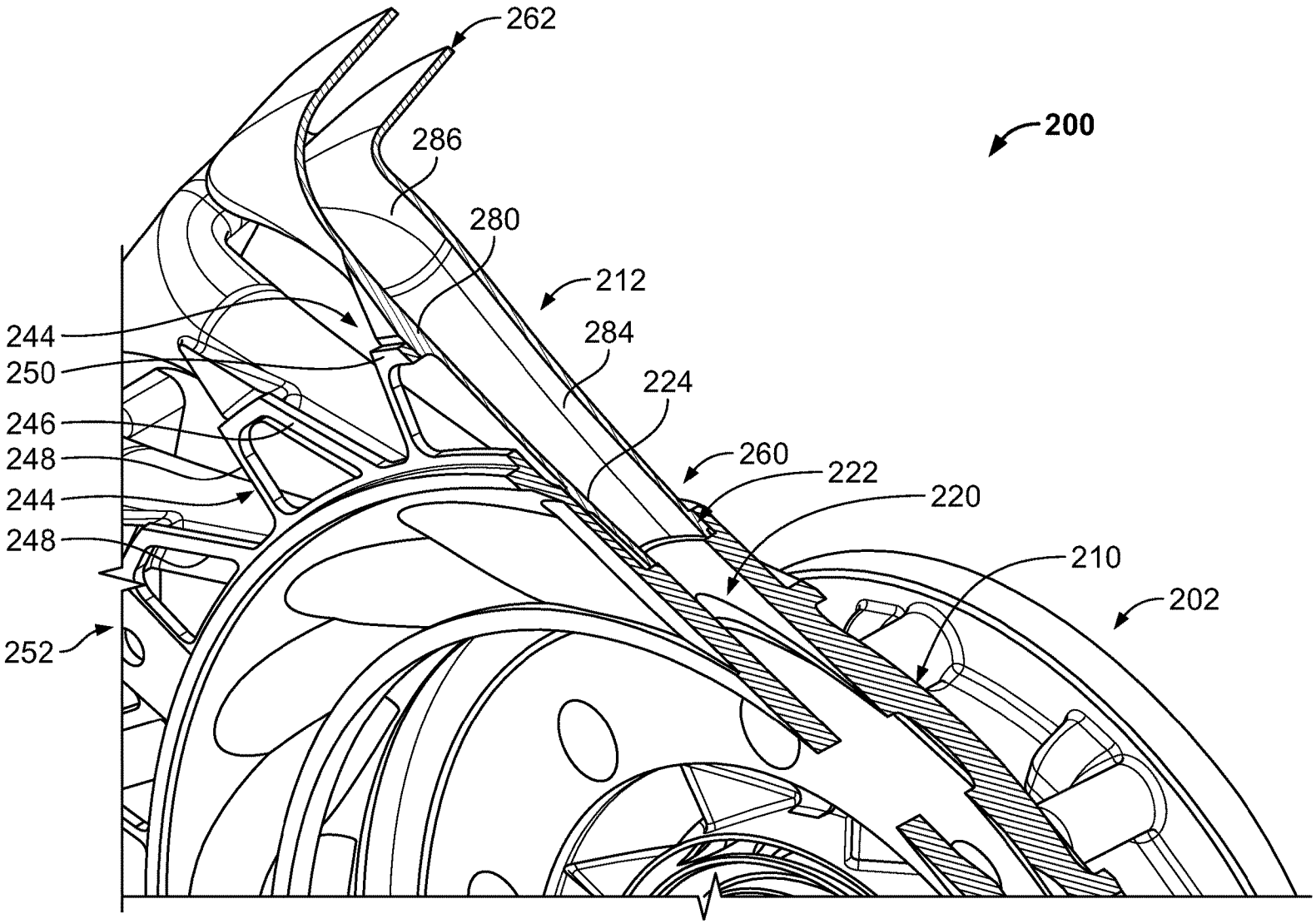
FIG. 8 is a cross-sectional view of the diffuser and deswirl system taken at line 8-8 of FIG. 11.

In this example, with reference to FIG. 7, the conduit 212 also defines the mating feature or protrusion 280. The protrusion 280 is substantially triangular in shape, and extends outwardly from the forward side 266 of the conduit 212. The protrusion 280 is spaced apart from the first conduit end 260 and the second conduit end 262, and in this example, is defined between the collar 270 and the bend 282 of the conduit 212 at the second conduit end 262. A base 284 of the protrusion 280 faces the collar 270, and an apex 286 of the protrusion 280 faces the second conduit end 262. With reference to FIG. 8, the base 284 is coupled to the bridge 250 of a respective support structure 244 when the conduit 212 is coupled to the throat ring 210. The coupling of the base 284 of the protrusion 280 to the support structure 244 of the throat ring 210 stiffens the conduit and eliminates certain vibratory modes in the operating range. The coupling of the protrusion 280 to the support structure 244 also provides structural stiffness for resisting vibratory modes. In one example, the base 284 of the protrusion 280 is welded to the bridge 250 of the support structure 244, which eliminates the need for mechanical fasteners and reduces a weight of the diffuser and deswirl system 200. Generally, the base 284 has a size similar to the size of the bridge 250 to provide for ease of assembly between the conduit 212 and the throat ring 210.

Figure 9:
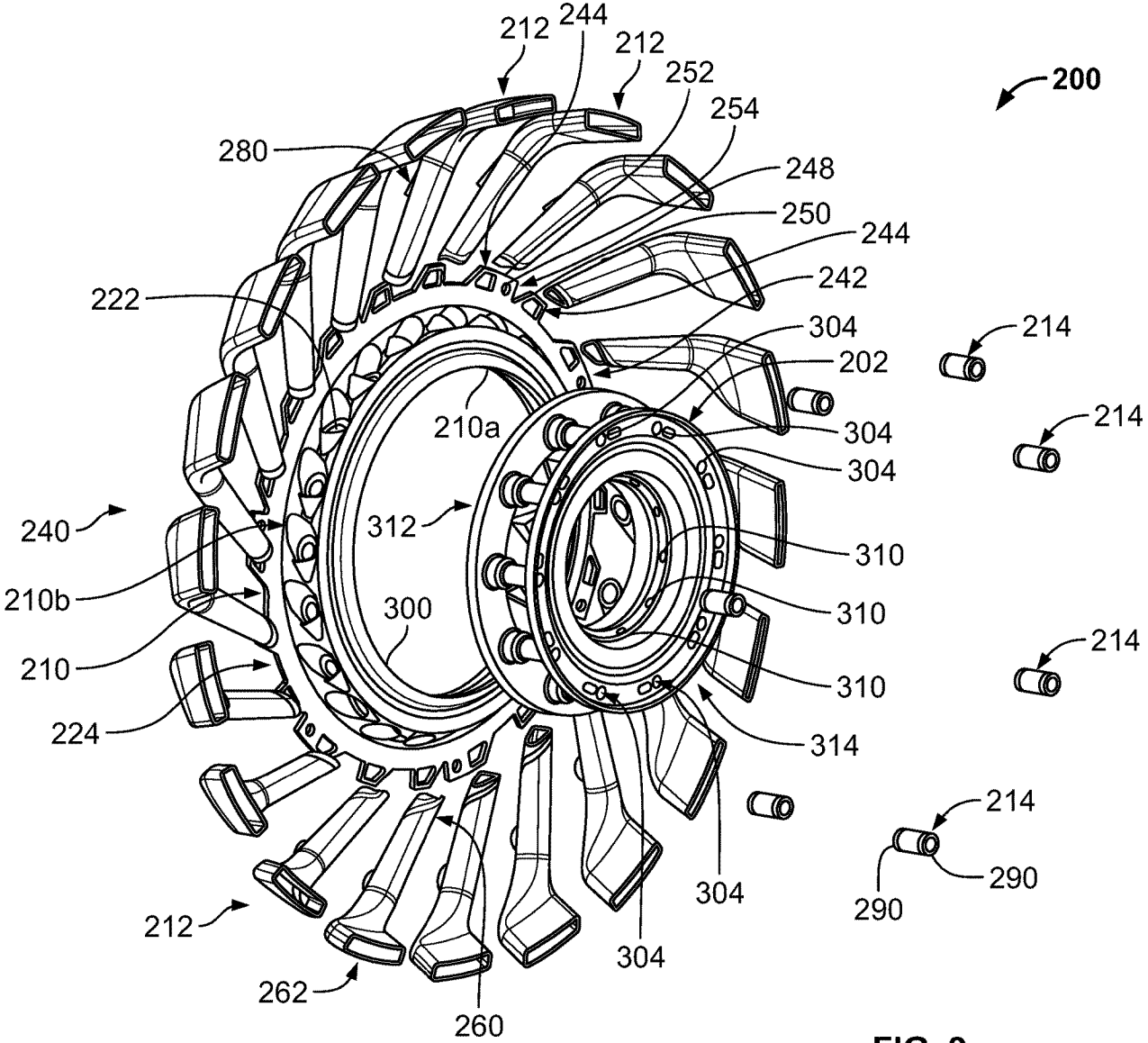
FIG. 9 is an exploded view of the diffuser and deswirl system, in which the integrally formed tangential on-board injector is also shown exploded from diffuser and deswirl system.

With reference to FIG. 9, an exploded view of the diffuser and deswirl system 200 is shown. In FIG. 9, the tangential on-board injector 202 is shown exploded from the diffuser and deswirl system 200 to illustrate features of the throat ring 210, however, as discussed, the tangential on-board injector 202 is integrally formed with the diffuser and deswirl system 200. The spacers 214 enable the receipt of mechanical fasteners through the bores 254 and between the conduits 212 to couple the diffuser and deswirl system 200 to a structure of the gas turbine engine 100. The spacers 214 are composed of a metal or metal alloy, and may be cast, stamped, forged, additively manufactured, etc. The spacers 214 are substantially cylindrical. The spacers 214 may include collars 290 at opposed ends to facilitate the coupling of the spacer 214 to the flange bodies 252 and the mechanical fastener, respectively.

In this example, the tangential on-board injector 202 is integrally formed, monolithic or one-piece with the throat ring 210. In one example, the tangential on-board injector 202 is integrally formed with an injector coupling flange 300 defined on the aft side 242 of the throat ring 210. The injector coupling flange 300 extends radially inward from the inner diameter 210*a* of the throat ring 210. The tangential on-board injector 202 includes a plurality of tangential flow passages 302 and a plurality of coupling bores 304. The plurality of coupling bores 304 receive a respective mechanical fastener for coupling the tangential on-board injector 202 to a structure of the gas turbine engine 100. The tangential flow passages 302 receive bypass flow or bleed air from the compressor section 108, and accelerate the bleed air such that the tangential speed of the bleed air matches or exceeds that of the at least one radial turbine 120 at the radius where the cooling air flow is being introduced. This minimizes aerodynamic losses from the incoming cooling air. Each of the tangential flow passages 302 includes a nozzle inlet 308 (FIG. 10) and an outlet 310. Generally, a cross-sectional area of the tangential flow passages 302 becomes gradually smaller from the nozzle inlet 308 to the outlet 310.

Figure 11:
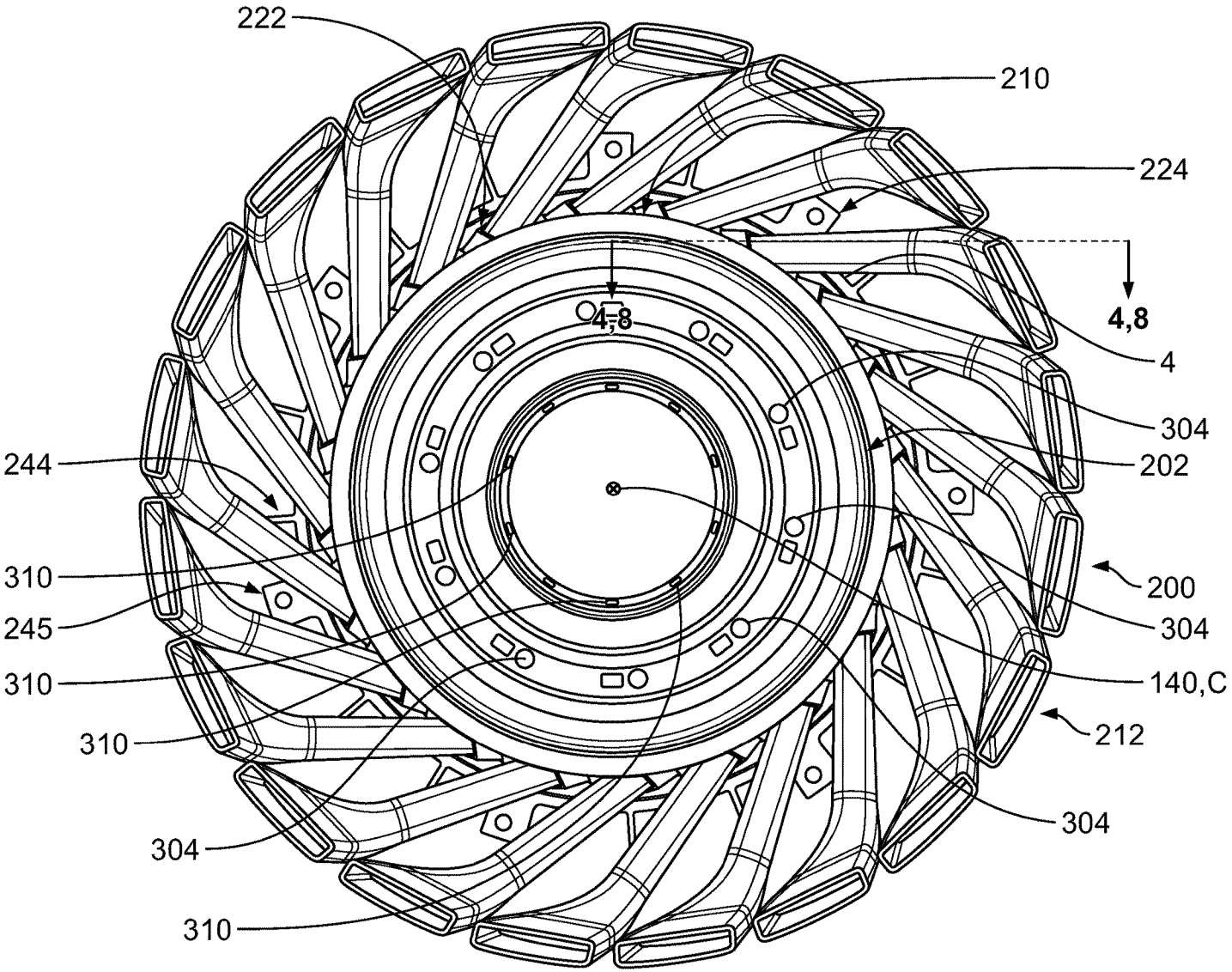
FIG. 11 is an aft side view of the diffuser and deswirl system and the integrally formed tangential on-board injector.

With reference to FIG. 10, the tangential on-board injector 202 is shown integrally formed with the diffuser and deswirl system 200. By integrally forming the tangential on-board injector 202 with the diffuser and deswirl system 200, a joint defined between the tangential on-board injector 202 and the throat ring 210 is structurally compliant and meets stress, life and durability requirements associated with the coupling of the tangential on-board injector 202 to the diffuser and deswirl system 200. As shown, the nozzle inlets 308 are spaced apart along a perimeter of the tangential on-board injector 202, and are defined between a first, forward side 312 of the tangential on-board injector 202 and an opposite second, aft side 314 of the tangential on-board injector 202. The tangential flow passages 302 generally change direction from the nozzle inlet 308 to the outlet 310 (FIG. 9) to introduce a tangential component to the bleed air that enters the nozzle inlet 308. With reference to FIG. 11, an aft end view of the diffuser and deswirl system 200 and the tangential on-board injector 202 is shown. As shown in FIG. 11, the outlet 310 of the tangential flow passages 302 is shown spaced apart about an inner diameter 202*a* of the tangential on-board injector 202.

In one example, in order to assemble the diffuser and deswirl system 200, the throat ring 210 is integrally formed with the tangential on-board injector 202, via additive manufacturing, for example. By additively manufacturing the passages 220 of the throat ring 210, additional steps, such as drilling or machining of the passages 220 may be eliminated. Further, by integrally forming the tangential on-board injector 202 with the diffuser and deswirl system 200, mechanical fasteners are eliminated between the tangential on-board injector 202 and the diffuser and deswirl system 200, which reduces cost, complexity, and weight. In other embodiments, the throat ring 210 is formed separate and discrete from the tangential on-board injector 202, and the tangential on-board injector 202 is coupled to the throat ring 210 via welding, for example. The conduits 212 are each formed, via additive manufacturing, for example, which eliminates mechanical fasteners or other assembly steps to couple the first conduit end 260 to the second conduit end 262.

Each of the conduits 212 are inserted into a respective one of the pockets 222 such that the conduit 212 is fluidly coupled to the respective passage 220 of the throat ring 210. Each conduit 212 is inserted into the respective pocket 222 until the terminal end 260*a* (FIG. 4) contacts the mating surface 236 and the pocket flange 238 is received within the notch 274 abutting the collar 270 (FIG. 5). The base 284 of each protrusion 280 is also aligned with the bridge 250 of the respective support structure 144. With the conduit 212 positioned within the pocket 222, a braze alloy is applied along the perimeter of the intersection of the conduit 212 with the mating surface 236 of the pocket 222 and the braze surface 243 to form a seal between the conduit 212 and the throat ring 210. The braze joint also fixedly couples the conduit 212 to the throat ring 210. In one example, the braze joint is formed with NiBSi-4, which is low temperature braze alloy with excellent ductility and high strength as well as good corrosion resistance properties. It should be noted that other braze alloys may be used, including, but not limited to NICROBRAZ® 130 commercially available from Wall Colmonoy of Madison Heights, Mich., USA, or AMDRY™ 780 commercially available from Oerlikon Metco AG of Wohlen, Switzerland. In other embodiments, a weld may be formed between the conduit 212 and the throat ring 210 about the intersection of the conduit 212 with the pocket 222 to form the seal between the conduit 212 and the throat ring 210. The separation volume 239 (FIG. 5) enables the visual inspection of the braze joint or weld, which ensures that the braze joint or the weld is properly formed between the conduit 212 and the pocket 222 of the throat ring 210. The use of a braze joint or weld also eliminates mechanical fasteners, and thus, a weight of the diffuser and deswirl system 200.

A braze alloy is also applied between each bridge 250 and the base 284 of each protrusion 280. The braze joint between the bridge 250 and the protrusion 280 also fixedly couples the conduit 212 to the throat ring 210. In one example, the braze joint is formed with NiBSi-4, however, NICROBRAZ® 130 or AMDRY™ 780 may also be used. In other embodiments, a weld may be formed between the bridge 250 and the protrusion 280 to fixedly couple the conduit 212 to the throat ring 210. The assembly of the throat ring 210, the tangential on-board injector 202 and the conduits 212 may also be heat treated.

With the diffuser and deswirl system 200 assembled, the diffuser and deswirl system 200 and the tangential on-board injector 202 is installed on the gas turbine engine 100. In one example, the spacers 214 (FIG. 9) are coaxially aligned with the bores 254 of the coupling flanges 245 and mechanical fasteners, such as bolts, are used to couple the throat ring 210, and thus, the conduits 212 and the tangential on-board injector 202 to a structure of the gas turbine engine 100 (FIG. 1), such as a compressor case. The coupling bores 304 of the tangential on-board injector 202 receive mechanical fasteners, such as bolts, to couple the tangential on-board injector 202 to a structure of the gas turbine engine 100, such as a turbine case.

With the diffuser and deswirl system 200 and the tangential on-board injector 202 installed in the gas turbine engine 100 (FIG. 1), during operation of the gas turbine engine 100, with reference to FIG. 1, air from the compressor section duct 116 flows into the throat defined by the inner diameter 210*a* (FIG. 3) of the throat ring 210 and into the passages 220. From the passages 220, the air flows into the diffuser passage 264 defined at the first conduit end 260 of the conduit 212 and flows through the diffuser passage 264 to the second conduit end 262, which defines the deswirl. Air bled from the compressor section 108 (FIG. 1) is directed through the tangential flow passages 302 of the tangential on-board injector 202 (FIG. 9) and exits at the outlet 310 to provide cooling to at least the radial turbine 120.

Thus, the diffuser and deswirl system 200, which may include the integrally formed tangential on-board injector 202, reduces manufacturing complexity and cost by reducing a number of mechanical fasteners needed to assemble the diffuser and deswirl system 200 and the tangential on-board injector 202. In addition, as the relatively flexible individual conduits 212 are coupled to the relatively stiffer throat ring 210 without direct attachment between the conduits 212, when exposed to a low engine speed vibration environment, vibration may be reduced as the conduits 212 may move independently of each other. In addition, by providing the throat ring 210 with the pockets 222, the assembly of the conduits 212 is less complex, as the braze or weld joint defined between the conduit 212 and the pocket 222 is easily visually inspected due to the line of sight provided by the separation volume 239.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A diffuser and deswirl system associated with an engine, comprising:

a throat ring defining a plurality of passages spaced apart about a perimeter of the throat ring, a plurality of pockets and a support flange, each passage of the plurality of passages configured to receive a working fluid, each pocket of the plurality of pockets defined about a portion of a respective passage of the plurality of passages, and the support flange includes a plurality of support ribs that extend radially outward from the support flange; and a plurality of conduits, with each conduit including a first conduit end and a second conduit end opposite the first conduit end, the first conduit end of each conduit received within and coupled to the pocket of a respective one of the plurality of passages to receive the working fluid, and each conduit including a protrusion defined between the first conduit end and the second conduit end for coupling to at least one of the plurality of support ribs.

2. The diffuser and deswirl system of claim 1, wherein the plurality of support ribs are arranged in pairs of support ribs about the perimeter of the throat ring, with each support rib of the pairs of support ribs interconnected with a bridge, and the protrusion of each conduit is coupled to the bridge.

3. The diffuser and deswirl system of claim 2, wherein the protrusion extends above a surface of each conduit, and a base of the protrusion is coupled to the bridge.

4. The diffuser and deswirl system of claim 1, further comprising at least one coupling flange integrally formed with at least one of the plurality of support ribs.

5. The diffuser and deswirl system of claim 1, wherein the first conduit end of each conduit extends along a first axis that is coaxial with the respective one of the plurality of passages, and the second conduit end extends along a second axis, which is different than the first axis.

6. The diffuser and deswirl system of claim 1, wherein each passage of the plurality of passages is defined at an acute angle relative to the throat ring.

7. The diffuser and deswirl system of claim 6, wherein the throat ring includes a first side and a second side opposite the first side, and the support flange extends radially from the first side.

8. The diffuser and deswirl system of claim 1, wherein the first conduit end of each conduit includes a conduit coupling portion about a terminal end that is received within the pocket of the respective one of the plurality of passages and a collar that defines a notch that receives the respective pocket flange.

9. The diffuser and deswirl system of claim 1, further comprising a tangential on-board injector integrally formed with the throat ring.

10. The diffuser and deswirl system of claim 1, wherein each passage includes a passage inlet opposite a passage outlet, and each pocket of the plurality of pockets is defined about a respective passage outlet.

11. The diffuser and deswirl system of claim 1, wherein each pocket of the plurality of pockets is defined about the portion of the respective passage to define a mating surface to stop an advancement of the first conduit end of the respective conduit within the respective passage.

12. The diffuser and deswirl system of claim 1, wherein each pocket of the plurality of pockets includes a pocket flange that partially surrounds the first conduit end.

13. The diffuser and deswirl system of claim 1, wherein the plurality of pockets are defined about the perimeter of the throat ring such that a volume is defined between adjacent pockets of the plurality of pockets.

14. The diffuser and deswirl system of claim 1, wherein each pocket of the plurality of pockets is partially recessed into the throat ring such that the first conduit end is received within the throat ring.

15. A diffuser and deswirl system associated with an engine, comprising:

a throat ring defining a plurality of passages spaced apart about a perimeter of the throat ring, a plurality of pockets and a support flange, each passage of the plurality of passages configured to receive a working fluid, each pocket of the plurality of pockets defined about a portion of a respective passage of the plurality of passages and recessed at least partially into the throat ring, each pocket of the plurality of pockets includes a pocket flange and the support flange includes a plurality of support ribs that extend radially outward from the support flange; and a plurality of conduits, with each conduit including a first conduit end and a second conduit end opposite the first conduit end, the first conduit end of each conduit received within and coupled to the pocket of a respective one of the plurality of passages to receive the working fluid, the pocket flange at least partially surrounding the first conduit end, each conduit including a protrusion defined between the first conduit end and the second conduit end that extends outwardly and is coupled to at least one of the plurality of support ribs.

16. The diffuser and deswirl system of claim 15, wherein the plurality of support ribs comprise pairs of support ribs about the perimeter of the throat ring, with each support rib of the pairs of support ribs interconnected with a bridge, and the protrusion of each conduit is coupled to the bridge.

17. The diffuser and deswirl system of claim 15, wherein the throat ring includes a first side and a second side opposite the first side, the support flange extends radially from the first side and a tangential on-board injector is integrally formed with the second side of the throat ring.

18. The diffuser and deswirl system of claim 15, wherein the first conduit end of each conduit includes a conduit coupling portion about a terminal end that is received within the pocket of the respective one of the plurality of passages and a collar that defines a notch that receives the respective pocket flange.

19. The diffuser and deswirl system of claim 15, wherein each pocket of the plurality of pockets is defined about the portion of the respective passage to define a mating surface to stop an advancement of the first conduit end of the respective conduit within the respective passage.

* * * * *